United States Patent [19]

Tanigawa et al.

[11] 4,193,681

[45] Mar. 18, 1980

[54] LIQUID FEEDING DEVICE

[75] Inventors: Koichi Tanigawa; Takayuki Ishihara, both of Tokyo, Japan

[73] Assignee: Canon Kabushiki Kaisha, Tokyo, Japan

[21] Appl. No.: 918,924

[22] Filed: Jun. 26, 1978

[30] Foreign Application Priority Data

Jun. 30, 1977 [JP] Japan ..... 52-78402
Dec. 29, 1977 [JP] Japan ..... 52-160897

[51] Int. Cl.[2] ..... G03G 15/00; F27B 9/28

[52] U.S. Cl. ..... 355/3 FU; 118/667; 118/699; 118/60; 118/268; 222/187; 432/60

[58] Field of Search ..... 355/3 R, 3 FU; 118/5, 118/7, 60, 260, 268; 222/187; 432/60, 228; 219/216

[56] References Cited

U.S. PATENT DOCUMENTS

| | | | |
|---|---|---|---|
| 2,678,024 | 5/1954 | Kresse | 118/268 X |
| 3,094,068 | 6/1963 | Gericke | 118/260 X |
| 3,412,707 | 11/1968 | West | 118/5 |
| 3,799,401 | 3/1974 | Braun et al. | 222/187 X |
| 4,011,353 | 3/1977 | Okamoto et al. | 118/60 X |

FOREIGN PATENT DOCUMENTS

| | | | |
|---|---|---|---|
| 2619386 | 11/1976 | Fed. Rep. of Germany | 355/3 FU |

*Primary Examiner*—Fred L. Braun
*Attorney, Agent, or Firm*—Fitzpatrick, Cella, Harper & Scinto

[57] ABSTRACT

A liquid feeding device for feeding a liquid accommodated in a reservoir through a liquid holding member to an object, onto which the liquid is to be fed, wherein the liquid holding member takes up the liquid in the reservoir and holds the same therein, and the feeding quantity of the liquid to the object can be maintained constant by controlling a vertical distance between the liquid surface level in the reservoir and a point where the liquid holding member and the object contact each other, this vertical distance being made variable depending on whether the device is in operation, or not, and on the liquid temperature as well.

11 Claims, 15 Drawing Figures

LIQUID FEEDING DEVICE

BACKGROUND OF THE INVENTION a. Field of the Invention

This invention relates to a device for feeding liquid. Generally, the technique of feeding liquid has been widely used in many practical fields such as, for example, feeding devices for printing ink, liquid applying devices utilizing a coater, devices for maintaining constant a concentration of developing liquid, feeding devices for offset preventing liquid to an image fixing roller for electrophotographic apparatus, and others. In this liquid feeding technique, however, maintenance of the liquid feeding quantity at a constant level is one of the important problems. In order to attain the constant feeding quantity, there have been made various efforts, and the present invention also aims at such solution to the problem.

b. Description of Prior Art

For the purpose of explanations of the prior known art to more readily understand the unique features of the present invention, an offset preventing liquid feeding device for a heat-roller image-fixing device which has already been put into practice in the image fixing section of the electrophotographic apparatus is taken as an example. It should, however, be understood that the present invention as will be described hereinafter is not limited to this particular device alone.

In the electrophotographic method, there have been practised the process steps of forming an electrostatic latent image in utilization of a photoconductive substance, developing the latent image with charged fine powder, then transferring the developed image onto an image holding member, and finally fixing the fine powder onto the image holding member by heat. When the dry powder development system is adopted, there is widely used a heat-roller image-fixing device, in which the image holding member carrying thereon the developed image is caused to pass between a heated roller and a pressure roller. In this kind of image-fixing device, there tends to occur adherence of the fine powder constituting the developed image to the heating roller due to its fusion, which has been one of the causes of deterioration in the image quality. In order to prevent this so-called "offset" phenomenon, there has been practised a method, in which silicone rubber, tetrafluoroethylene, and like other substances having a small surface free energy is used as a material for the surface layer of the heating roller to contact with the developed image, and a film of the offset preventing liquid such as silicone oil, etc. is formed on the surface layer. While the offset phenomenon can be avoided by this method, there would arise a new problem depending on the quantity of the offset preventing liquid. That is, when the feeding quantity of the offset preventing liquid is small, the offset phenomenon tends to take place readily, while, when the quantity is large, excessive amount of the liquid brings about swelling of the silicone rubber and like material to lower its durability, and produces stain on the developed image holding member, and also replenishment of the offset preventing liquid becomes necessary to be done in a shorter period of time.

Also, in the conventional offset preventing liquid feeding device for the heat-roll image-fixing device, the liquid feeding quantity fluctuates between the commencement of the feeding operation and the long hours' continuous feeding operation. Particularly, the feeding quantity at the commencement of the operation is excessive in comparison with that during the long hours' continuous operation, and the abovementioned inconvenience occurs accordingly. In such device, since the liquid feeding quantity is so determined that the offset phenomenon may be avoided even when the feeding quantity is at the minimum, there is no possibility at all to solve the abovementioned inconvenience which is brought about by increase in the feeding quantity over its appropriate one.

SUMMARY OF THE INVENTION

It is an object of the present invention to provide a method and an apparatus for feeding liquid which is capable of totally removing the abovementioned defects, and of controlling the feeding quantity of the liquid at a substantially constant level.

It is another object of the present invention to provide a method and an apparatus for feeding liquid which eliminates the causes for fluctuation in the liquid feeding quantity in accordance with the condition of the liquid feeding, and avoids excessiveness in the feeding quantity to thereby reduce waste of the liquid.

It is still another object of the present invention to provide a method and an apparatus for feeding liquid which controls the feeding quantity of the liquid by maintaining the liquid surface in the reservoir at a constant level.

It is further object of the present invention to provide a method and an apparatus for feeding liquid which controls the feeding quantity of the liquid at a constant level during its operation by changing the liquid surface level.

DESCRIPTION OF PREFERRED EMBODIMENTS

Figure 1:
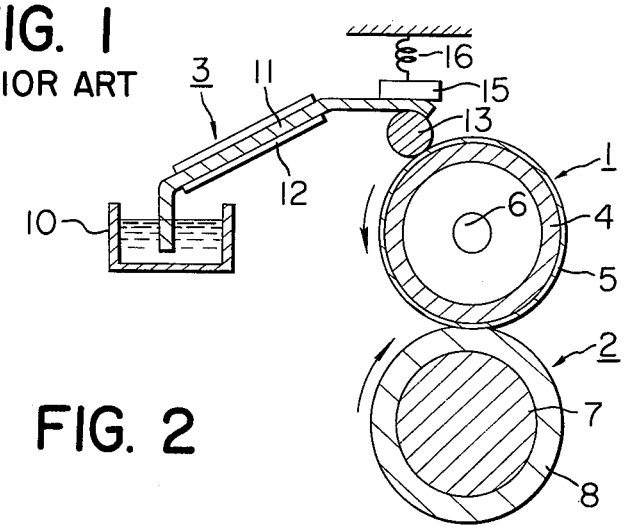
FIG. 1 PRIOR ART
FIG. 1 is a schematic structural diagram of a conventional image fixing device.

FIG. 1 shows one embodiment of the conventional heat fixing device which is constructed with a rotatable heat fixing roller 1, a pressure roller 2 which rotates while press-contacting the heat fixing roller 1, and a liquid feeding device 3 to feed the offset prevention liquid onto the surface of the fixing roller 1.

The heat fixing roller 1 comprises a metal tubing 4, a layer of tetrafluoroethylene resin 5 coated on the surface of the metal tubing 4, and a heater 6 disposed in the interior of the tubing 4.

The pressure roller 2 comprises a metal roller 7, and a layer of silicone rubber 8 coated on the surface of the roller 7. Any one of the rollers 1 and 2 is connected to a driving source, and both rotate in their respective directions as indicated by arrow marks.

The liquid feeding device 3 is constructed with a reservoir 10 containing therein silicone oil as the offset preventing liquid, a silicone oil holding member 11 made of felt, one end part of which is immersed in the liquid, a supporting member 12 which supports the liquid holding member 11 at its designated position, a liquid applying roller 13 which rotatably contacts the liquid holding member 11 and the heat fixing roller 1, and an urging member 15 which urges the liquid holding member 11 to the liquid applying roller 13 by means of a spring 16.

Silicone oil in the reservoir 10 is absorbed into the liquid holding member 11 by capillary action, is fed to the liquid applying roller 13, and further fed to the surface of the heat fixing roller 1 by means of the rotating liquid applying roller 13.

Figure 2:
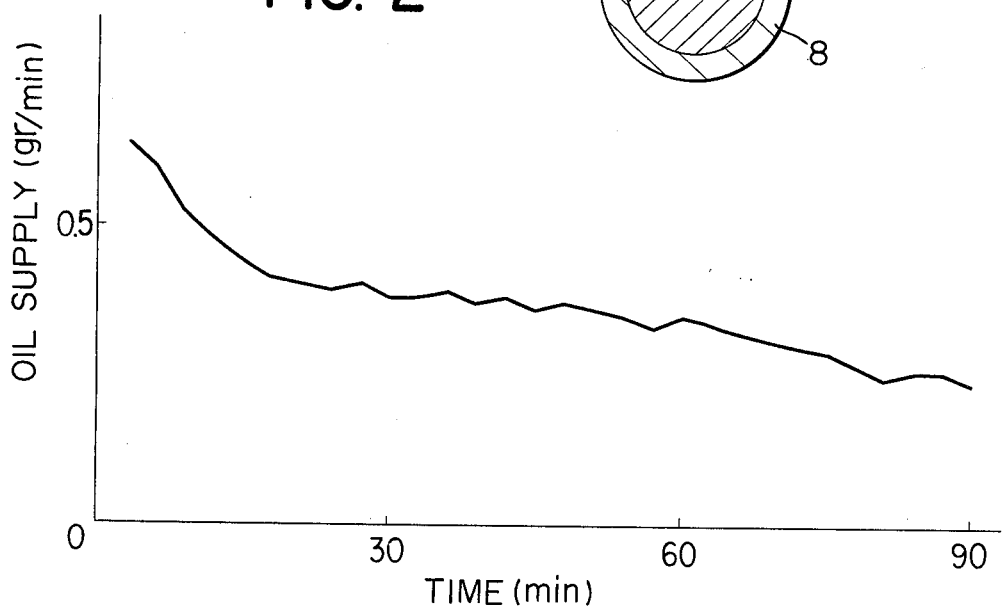
FIG. 2 is a graphical representation showing fluctuation in the feeding quantity of silicone oil in the device shown in FIG. 1.

In the above-described image fixing device, when the heat fixing roller 1 and the pressure roller 2 are rotated in the arrowed directions to actuate the liquid feeding device 3 thereby feeding silicone oil onto the surface of the heat fixing roller 1, the feeding quantity of silicone oil to the heat fixing roller varies during its operation. FIG. 2 shows the results of measurement of the silicone oil feeding quantity in the abovementioned image fixing device, wherein the abscissa denotes a time from the start of the silicone oil feeding, and the ordinate indicates the silicone oil feeding quantity to the heat fixing roller (corresponding to the take-up quantity in the liquid holding member 11). As is apparent from FIG. 2, the silicone oil feeding quantity to the heat fixing roller 1 is not constant throughout the period, but it is excessive at the outset of the operation (at the commencement of the feeding), and it reduces with lapse of time during the continuous feeding operation, thus causing various inconveniences as already pointed out in the foregoing.

Figure 3:
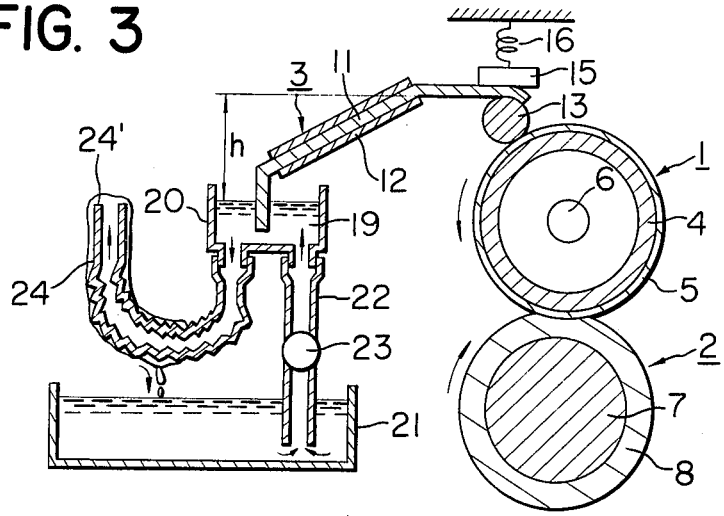
FIG. 3 is a schematic cross-sectional side view of one embodiment of the image fixing device according to the present invention.

FIG. 3 shows one embodiment of the image fixing device, to which the concept of the present invention has been applied. In this embodiment, those component parts having the same functions as those in FIG. 1 are designated by the same reference numerals and symbols.

Figure 4:
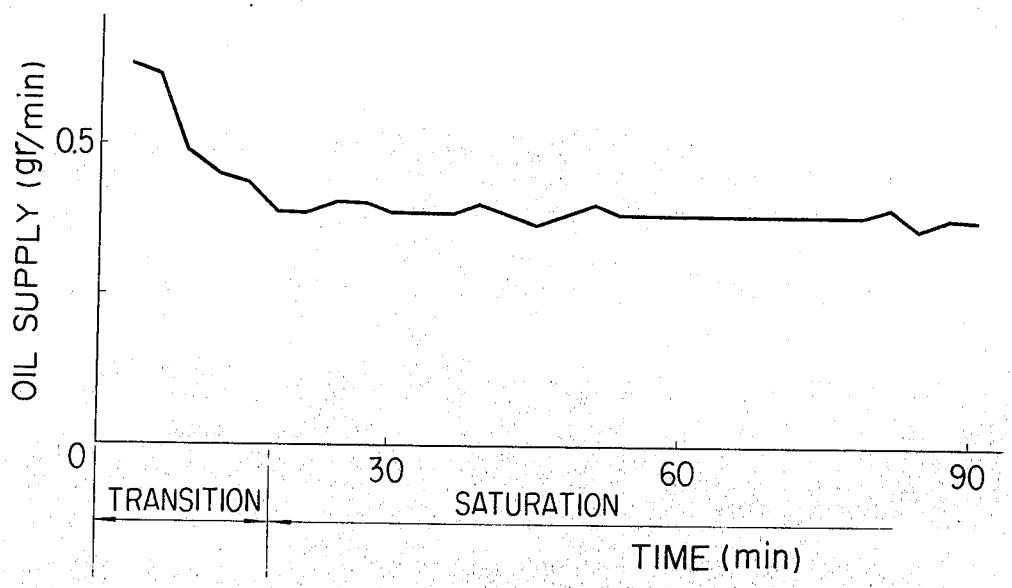
FIG. 4 is a graphical representation showing variations in the feeding quantity of silicone oil in the device shown in FIG. 3.
Figure 5:
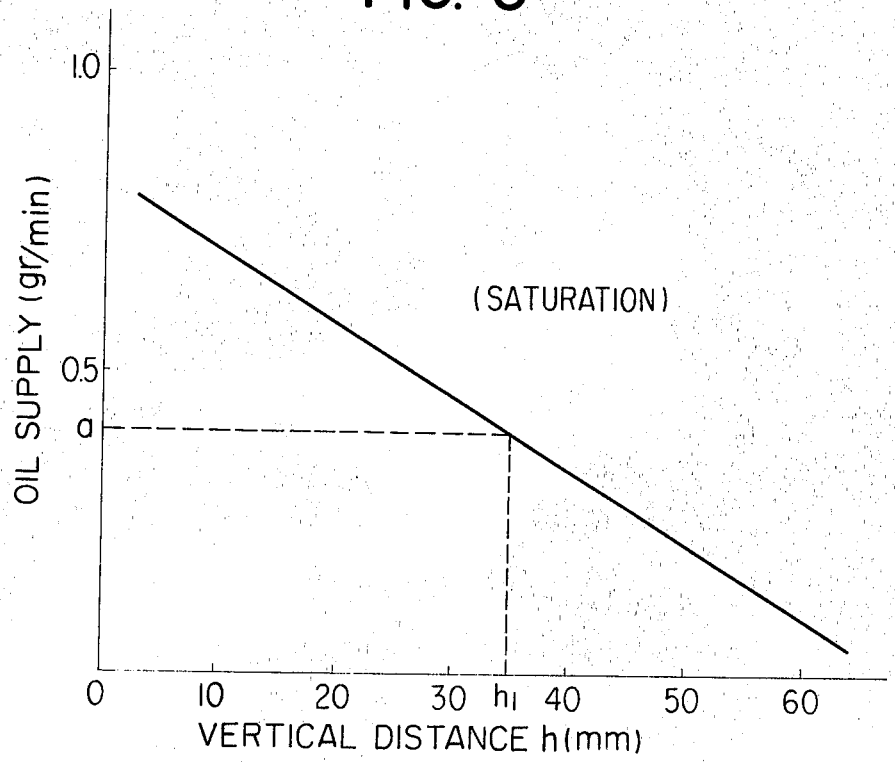
FIG. 5 is a graphical representation showing a relationship between the vertical distance and the silicone oil feeding quantity during a saturation period.
Figure 6:
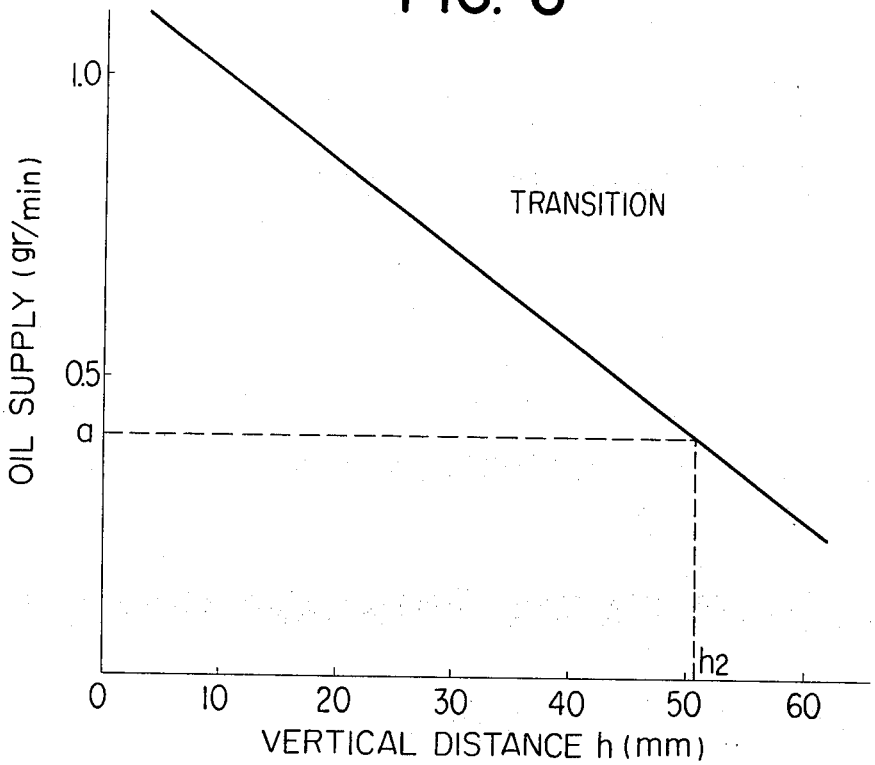
FIG. 6 is a graphical representation showing a relationship between the vertical distance and the silicone oil feeding quantity during a transition period.

In the drawing, reference numerals 20, 21 respectively designate first and second reservoirs, 22 refers to a liquid feeding pipe to feed silicone oil in the second reservoir 21 into the first reservoir 20, 23 a liquid (silicone oil) feeding pump, and 24 a recycling or feedback pipe to return the liquid in the first reservoir 20 into the second reservoir 21. The feedback pipe 24 is made of a soft material such as synthetic resin, and is movable in the vertical direction. When the liquid feeding pump 23 is driven to feed a definite quantity of silicone oil into the first reservoir, the liquid surface in the first reservoir 20 becomes hydrodynamically stabilized with the same liquid level as the tip end 24' of the liquid feedback pipe 24. In this state, when the heat fixing roller 1 and the pressure roller 2 are rotated, the liquid feeding device 3 starts its operation, whereby the liquid (silicone oil) held in the liquid holding member 11 by absorption is fed to the surface of the heat fixing roller 1 through the liquid applying roller 13. The liquid surface in the first reservoir 20 can be maintained at a constant level by positioning the tip end 24' of the liquid feedback pipe 24 at a definite level. Consequently, even if silicone oil in the reservoirs 20, 21 decreases in quantity due to its feeding to the heat fixing roller 1, there can be maintained a constant vertical distance h between the liquid surface level in the first reservoir 20 and a position where the liquid holding member 11 contacts the liquid applying roller 13, whereby the feeding quantity of silicone oil to the heat fixing roller 1 is controlled and the variations in the feeding quantity can be kept minimal. FIG. 4 shows the result of measurement of the silicone oil feeding quantity, when the liquid surface level in the first reservoir 20 is maintained constant in the device shown in FIG. 3. As is apparent from FIG. 4, the silicone oil feeding quantity becomes substantially constant and the stable image fixing operation can be effected during a period of long hours' continuous operation (this period will hereinafter be called "saturation period"), except for a period for commencement of the operation (this period will hereinafter be called "transition period"). The liquid feeding quantity during the transition period is excessive in comparison with the feeding quantity during the long hours' of continuous operation, whereby the feeding quantity varies. This variation in the feeding quantity during the transition period can be explained in the following circumstances. One end of the liquid holding member 11 is immersed in silicone oil in the first reservoir 20, and the density distribution of silicone oil taken up in this liquid holding member 11 during non-operative period of the image fixing device is a hydrostatically saturated condition. With commencement of operation of the device, the liquid holding member 11 takes up silicone oil, whereby the density distribution of the liquid in the liquid holding member 11 shifts to a hydrodynamically saturated condition (a standing condition). That is to say, a transition condition appears during the transition period as shown in FIG. 4, wherein variation in the liquid feeding quantity occurs due to a difference in the density distribution between the hydrostatically saturated condition and the hydrodynamically saturated condition. In order therefore to eliminate such inconvenience, it may be effective to set a greater vertical distance h between the liquid surface in the first reservoir and the position where the liquid holding member contacts the other component members in the non-feeding period than in the feeding period. FIGS. 5 and 6 show the results of measurement of the silicone oil feeding quantity by varying the abovementioned vertical distance h in the above-described image fixing device, wherein FIG. 5 indicates the measured results during the saturation period, while FIG. 6 represents the measured results during the transition period. It is to be noted in reading these graphical representations that the feeding quantity is denoted by mean values, and silicone oil is maintained at a constant temperature. As will be clearly understood from FIGS.

5 and 6, the silicone oil feeding quantity varies in accordance with variations in the vertical distance h in both saturation and transition periods.

Figure 7:
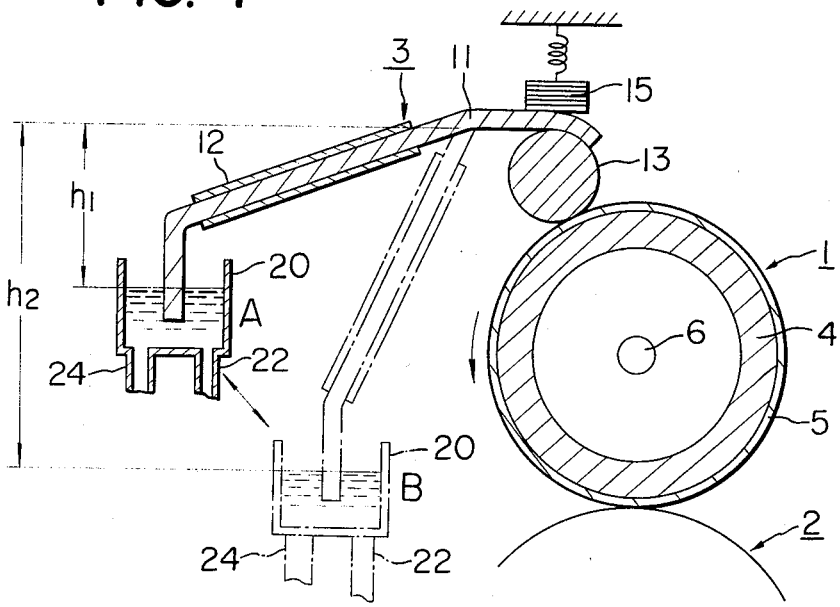
FIG. 7 is a schematic cross-sectional side view of another embodiment of the image fixing device according to the present invention.

FIG. 7 illustrates another embodiment of the present invention, wherein those component members having the same functions as those in the previous embodiment are designated by the same reference numerals and symbols.

In FIG. 7, the first reservoir 20 is the same as that shown in FIG. 3, although the second reservoir 21, the liquid feeding pump 23, the liquid feedback pipe 24, and other related component members of the silicone oil circulating system are omitted from illustration for simplicity of explanations. The liquid surface level in the first reservoir 20 is, however, still made to be maintained at a definite position. The first reservoir 20 is movable between a position A (shown in solid lines) and a position B (shown in dot-and-dash lines) by a moving mechanism (not shown). It is also to be noted that the liquid feeding pipe 22 is freely extendable and shrinkable, the second reservoir 21 is fixed at a definite position, the first reservoir is movable with the liquid feedback pipe 24, and the liquid feeding pipe 22 extends and shrinks in accordance with movement of the first reservoir 20. The first reservoir 20 is at the position A when it is in operation, i.e., when it feeds silicone oil to the heat fixing roller 1, and is at the position B when it is in non-operation, i.e., when it does not feed the liquid. Reference letters $h_1$ and $h_2$ respectively indicate the vertical distance between the liquid surface in the first reservoir 20 and the position where the liquid holding member 11 contacts the liquid applying roller 13, when the first reservoir is at the respective positions A and B. According to this construction of the liquid feeding device, the silicone oil feeding quantity can be maintained substantially at a constant level in both the transition and saturation periods by moving the first reservoir 20 to the mentioned positions A and B in accordance with operation or non-operation of the liquid feeding device, whereby the intended object can be attained.

Figure 8:
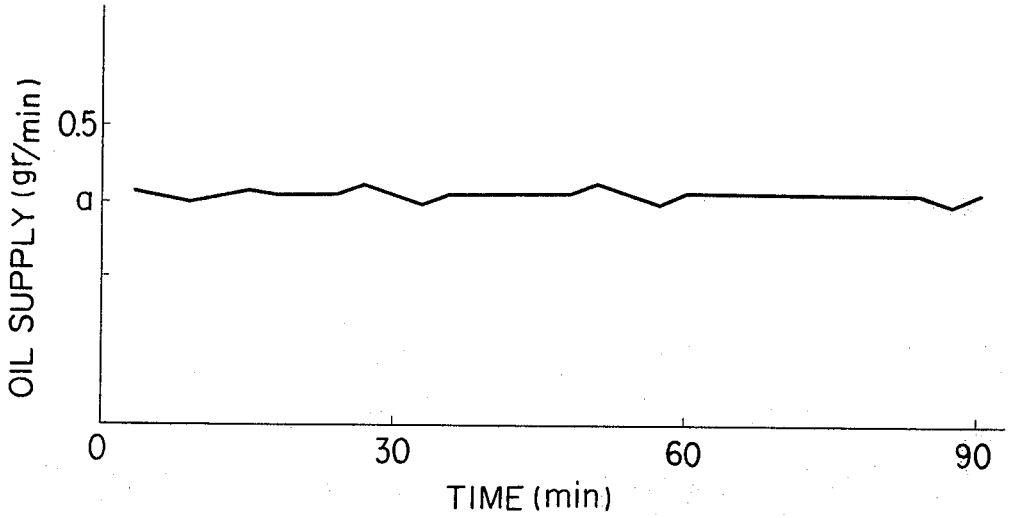
FIG. 8 is a graphical representation showing variations in the silicone oil feeding quantity in the device shown in FIG. 7.

FIG. 8 shows the results of measurement of the liquid feeding quantity by first determining from FIGS. 5 and 6 the position of the first reservoir 20 in its feeding operation and non-feeding operation so as to maintain constant the liquid feeding quantity during the feeding operation, and then setting the vertical distance during the saturation period as $h_1$ and that during the transition period as $h_2$. As is apparent from FIG. 8, the liquid feeding quantity during the feeding operation is maintained at a constant quantity a.

Figure 9:
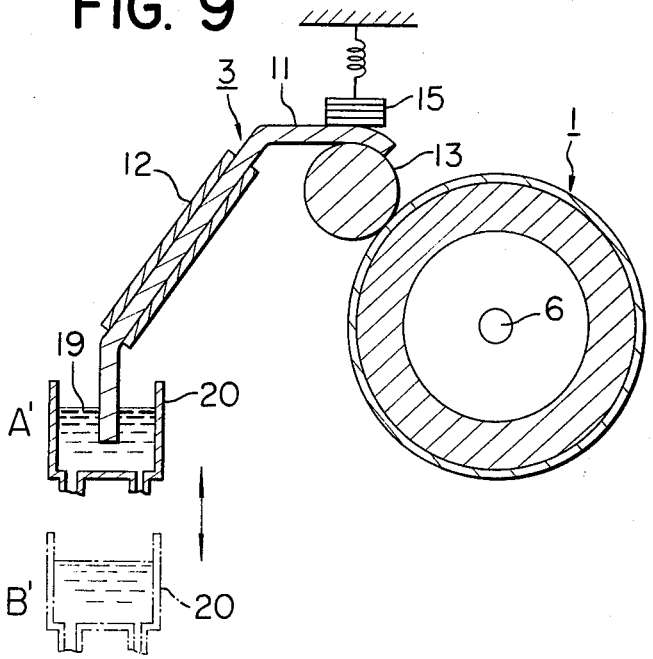
FIGS. 9 through 13B are respectively schematic cross-sectional side views of further embodiments of the image fixing device according to the present invention.

FIG. 9 illustrates still another embodiment of the liquid feeding device according to the present invention, wherein the first reservoir 20 is shifted to a position B' where the liquid holding member 11 is not immersed in silicone oil 19 in the reservoir 20 at the time of non-feeding operation, and shifted to a position A' where the liquid holding member 11 is immersed in the liquid at the time of the feeding operation, thereby always maintaining the density distribution of silicone oil in the liquid holding member 11 at a hydrodynamically saturated condition.

The controlling expedient for this vertical distance is not limited to the abovementioned embodiment, but various other expedients may, of course, be adopted. As an example, the contact position between the liquid holding member and the liquid applying roller may be so constructed that it changes in the vertical direction.

In addition to the foregoing statement, the following consideration should be taken to maintain the liquid feeding quantity at a constant level. That is, silicone oil varies in viscosity depending on variations in temperature, and reduces its viscosity with a temperature increase. More concretely, in the image fixing device, silicone oil is heated by heat from the heat-fixing roller, and other component members, owing to which the temperature of silicone oil rises with operation of the liquid feeding device to result in variations in the feeding quantity of silicone oil. On account of this, it becomes necessary to control the feeding quantity of silicone oil with respect to the temperature variation so as to effect stable image fixing operation.

Figure 10:
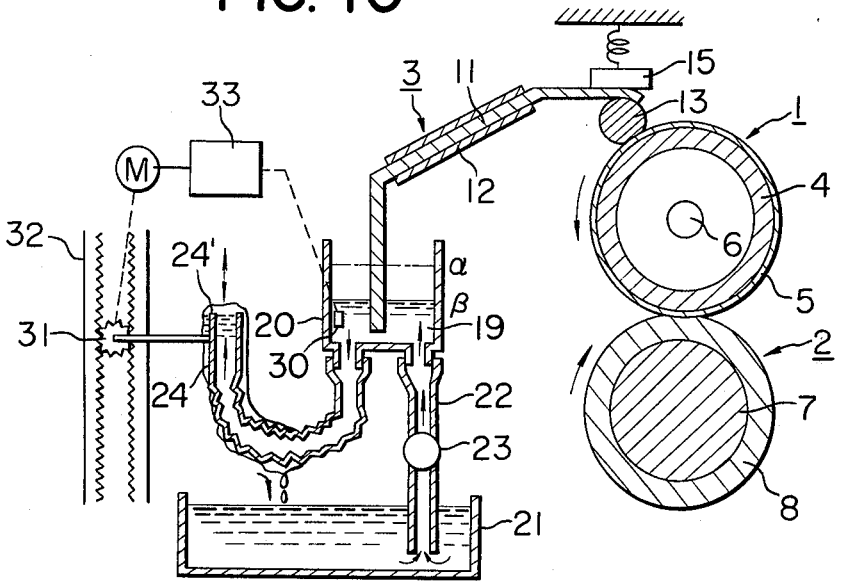

FIG. 10 illustrates one embodiment of the image fixing device of a construction, wherein the vertical distance h is made variable in accordance with temperature of silicone oil. In the drawing, a reference numeral 30 designates a silicone oil temperature detector consisting of a thermistor, 31 refers to a pinion coupled to the liquid feedback pipe 24, 32 denotes a fixed rack to be meshed with the pinion 31, M designates a motor connected to the pinion 31 to drive the same, and 33 refers to a drive control circuit of a known type to control rotation of the motor M in accordance with a detected temperature by the temperature detector 30. During the operation of the image fixing device, when the temperature of silicone oil changes, being affected by heat from the device per se and ambient temperature, the thermistor 30 detects the oil temperature to emit a detection signal, based on which the drive control circuit 33 actuates to drive the motor M, hence rotation of the pinion 31, whereby the tip end 24' of the liquid feedback pipe 24 moves in the vertical direction. As the result, the liquid surface level in the first reservoir 20 varies, and the feeding quantity of silicone oil is controlled. The liquid surface level in the first reservoir varies in such a manner that it may come close to a lower position $\beta$ when the silicone oil temperature becomes high, and to an upper position $\alpha$ when the temperature becomes low, whereby the feeding quantity thereof can be constantly controlled irrespective of the temperature variations.

In the foregoing embodiments of the present invention, explanations have been given as to the offset preventing liquid feeding device as an example. It will, of course, be understood readily that the present invention is not limited to this example alone, but it may be applied to other liquid feeding devices using various kinds of liquid. In the afore-described embodiments, the liquid holding member 11 and the liquid applying roller 13 are in contact with each other for the liquid feeding. It is possible to directly contact the liquid holding member 11 to the heat-fixing roller 1 without providing the liquid applying roller 13.

Figure 11:
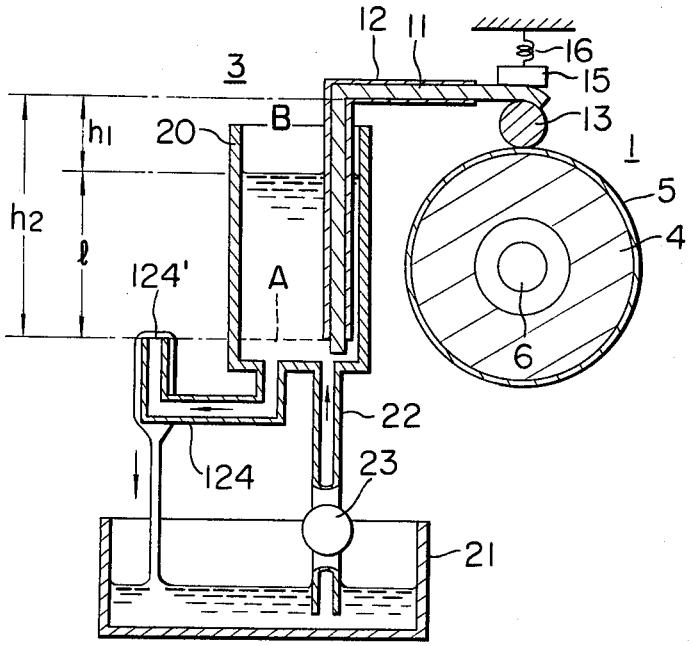
Figure 12:
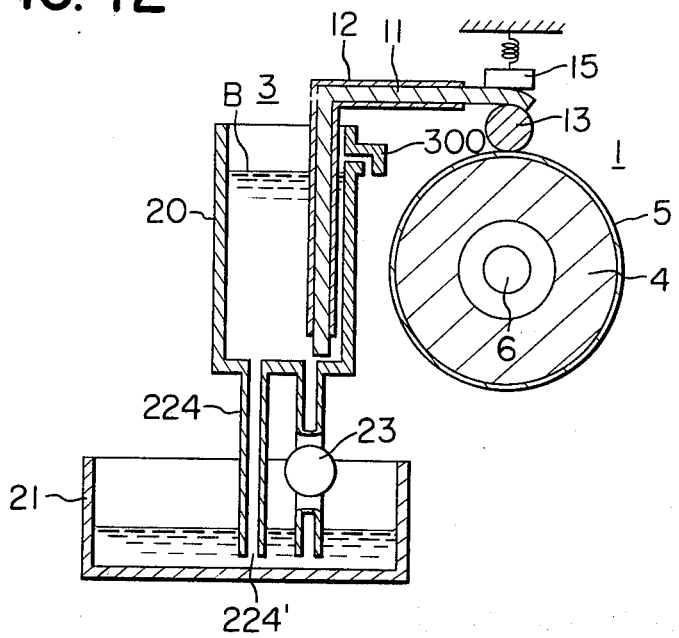

FIGS. 11 and 12 illustrate further embodiments of the present invention. In FIG. 11, when the liquid feeding pump 23 is operated to feed a definite quantity Q ($cm^3$ $sec.^{-1}$) of silicone oil, the liquid surface in the first reservoir 20 shifts from the position A (shown by a dot line) where it is hydrostatically stabilized at the level flush with the tip end 124' of the liquid feedback pipe 124 to the position B (shown by a solid line) where it becomes hydrodynamically stabilized. The head l(cm) between the positions A and B substantially satisfies the following equation.

$$l=(8QL\eta)/(\pi\gamma^4\rho\cdot g) \quad (1)$$

(where: $\eta$(g·cm$^{-1}$ sec$^{-1}$) denotes a coefficient of viscosity of silicone oil; L(cm) represents a length of the liquid feedback pipe 124; $\gamma$(cm) is a radius of the liquid feedback pipe 124; $\Sigma$(g·cm$^{-3}$) is a density of silicone oil; g(cm sec$^{-2}$) denotes gravity.) (The viscosity of silicone oil is in most cases represented by a unit of measurement of "Stockes S", in which the dynamic coefficient of viscosity $\eta/\rho$ (cm$^2$ sec$^{-1}$) is in the CGS unit. In the case of liquid having a large coefficient of viscosity such as silicone oil, the relationship in the above equation (1) holds good.)

As is apparent from the above equation (1), the head l takes a definite value depending on the feeding quantity Q of silicone oil. That is to say, when silicone oil is fed in a predetermined quantity by the liquid feeding pump, the head l can be maintained constant. One example of the result of experiment conducted by the embodimental construction of FIG. 11 is as follows.

| Liquid Feeding Quantity Q (cm$^3$ sec$^{-1}$) | Head l (cm) |
|---|---|
| 0.91 | 6.3 |
| 0.23 | 1.6 |

In the above experiment, the radius of the liquid feedback pipe 124 was $\gamma=0.45$ cm, its length was L=100 cm, and the dynamic coefficient of viscosity was $\eta/\rho=100$ CS (centi-stockes)$=10^{-2}$S.

In utilization of this phenomenon, the liquid feeding pump 23 is operated simultaneously with commencement of the image fixing operation, for example, whereupon the liquid surface level in the first reservoir 20 shifts from A to B gradually. In the above-described experiment, a time period of about 30 minutes was necessary for producing the head of l=6.3 cm. In this way, the vertical distance h between the liquid surface level and the position where the liquid holding member (e.g., felt) 11 contacts the liquid applying roller 13 changes from $h_2$ to $h_1$, whereby the vertical distance h varies so as to maintain constant the take-up quantity of the liquid in accordance with a change from the hydrostatically saturated state of the liquid holding member 11 with silicone oil to the hydrodynamically saturated state thereof, wherein the liquid holding member is pumping up silicone oil.

Further, this kind of silicone oil applying device may, on some occasion, bring about a temperature rise in the overall device, being affected by heat from the heat-fixing roller 1. In this case, if the liquid surface level of silicone oil in the first reservoir 20 is maintained constant, the coefficient of viscosity $\eta$ of the liquid decreases with increase in temperature, on account of which the take-up quantity of silicone oil increases. According to the present invention, however, the decrease in the coefficient of viscosity $\eta$ induces decrease in the head, i.e., increase in the vertical distance h. Thus, the silicone oil feeding device functions to maintain the feeding quantity at a constant level with the change in coefficient of viscosity $\eta$ as a buffer.

Observing variations in the liquid surface level due to temperature change in the case of the dynamic coefficient of viscosity $\eta/\rho=100$ (cm$^2$ sec$^{-1}$) at a normal temperature, the following data can be derived from one experimental example.

| Temperature (°C.) | Head (cm) |
|---|---|
| 20 | 6.3 |
| 100 | 1.9 |

The experimental conditions are exactly the same as those in the previous experiment with the exception of the feeding quantity being Q=0.91 (cm$^3$ sec$^{-1}$).

FIG. 12 illustrates one embodiment of the liquid feeding device, wherein the liquid holding member 11 is separated from the silicone oil reservoir during the non-feeding time of the liquid. This construction can satisfactorily function when certain definite fluctuation are permitted to the liquid feeding quantity. In the heretofore known embodimental construction of the liquid feeding device, the liquid surface level has been controlled by overflowing the liquid, detecting the liquid surface level by a float, and so forth. These known devices, however, require additional means to properly and variably control the liquid surface level. The present invention, on the contrary, does not require such additional expedient, but is characterized in that the feeding quantity Q of silicone oil per se controls the liquid surface level. The difference between the embodiments shows in FIG. 11 and 12 is that the tip end 224' of the liquid feedback pipe 224 is downwardly directed, whereby, when the liquid feeding pump 23 stops feeding silicone oil, the liquid surface in the first reservoir 20 lowers to the liquid surface in the second reservoir 21. In this embodiment in FIG. 12, there is further provided an overflow pipe 300 which functions as a safety device to maintain the liquid feeding quantity at a constant level when the feeding quantity increases more than required due to abnormal operation of the liquid feeding pump 23. This overflow pipe 300 is not usually active.

According to the above-described embodiments of the liquid feeding device, the liquid feeding operation is made possible by the "on-and-off" operation of an input electrical signal to the liquid feeding pump 23, or the sequence control of an input voltage thereto, etc., or others without necessity for the liquid surface level in the first reservoir 20 to move any part of the device mechanically, so that the device is very convenient and effective as the expedient for carrying out the purpose of feeding a definite quantity of liquid.

Figure 13A:
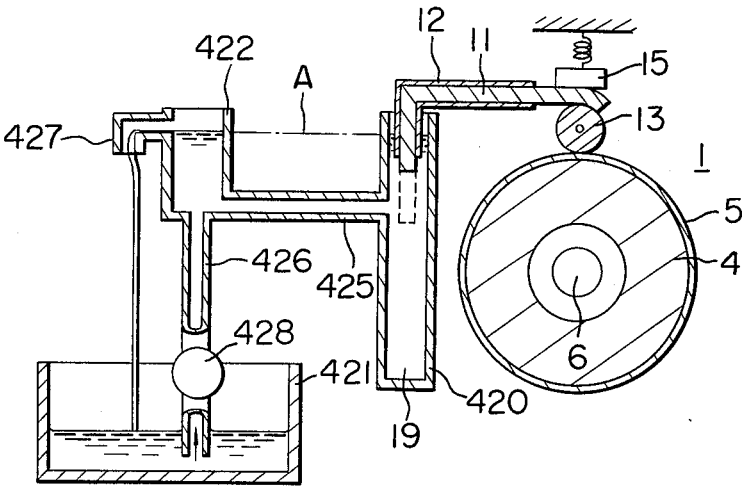
Figure 13B:
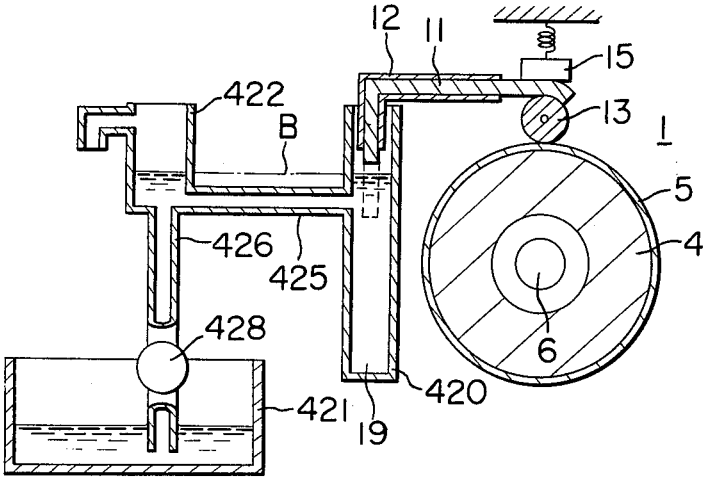

FIGS. 13A and 13B illustrate a further embodiment of the present invention, wherein the abovementioned vertical distance or head l is controlled. That is, the liquid surface level in the reservoir is controlled by utilization of a phenomenon of temperature increase and thermal expansion of silicone oil due to heat from the heat-fixing roller.

In the drawing, reference numerals 420, 421, and 422 respectively designate first, second, and third reservoirs to accommodate therein silicone oil. The first reservoir 420 and the third reservoir 422 are connected by a communicating pipe 425, while the second reservoir 421 and the third reservoir 422 are connected by a communicating pipe 426. A numeral 427 refers to a liquid feedback pipe for the third reservoir 422. The liquid surface level of silicone oil in the first reservoir 420 is maintained at a position A, where the liquid holding member 11 is immersed in oil in the first reservoir 420, as shown in FIG. 13A by silicone oil in the second reservoir 421 being pumped up by means of the liquid feeding pump 428 into the first reservoir 420 through the third reservoir 422 at the time of the liquid feeding operation, and by silicone oil in the third reservoir 422 being discharged through the liquid feedback pipe 427. Also, since the third reservoir 422 and the first reservoir 420 are connected by the communicating pipe 425, the liquid surfaces in both reservoirs are constantly maintained at a definite and same level. On the other hand, when the heater 6 is electrically conducted for a definite period of time, silicone oil in the first reservoir is subjected to thermal expansion due to heat from the heat-fixing roller, because the first reservoir is disposed in proximity to the heat-fixing roller. The thermally expanded silicone oil is then recovered into the second reservoir 421 through the liquid feedback pipe 427, while maintaining the liquid surface at the position A. Next, when the electric conduction to the heater 6 is interrupted and the liquid feeding pump 428 is stopped (i.e., non-feeding period), silicone oil in the first reservoir 420 is gradually cooled, in accordance with which the volume of silicone oil in the reservoir contracts, and the liquid surface lowers to a position B where the liquid holding member 11 is not immersed in the liquid, as shown in FIG. 13B. Incidentally, the position B in the first reservoir 420 is the established liquid surface to feed a definite quantity of oil to the heat fixing roller during the feeding operation, as already mentioned in the foregoing, hence the liquid holding member 11 is permissibly immersed in the oil at this position as shown in FIG. 13B by a dot line. Here, a distance l, in which the liquid surface of silicone oil shifts from the position A to the position B can be represented by the following equation:

$$l=(\alpha \cdot V/S-\beta B)t$$

where:

$\alpha$ is an expansion ratio of oil due to temperature rise;

$\beta$ is an expansion ratio of the reservoir due to temperature rise;

V is the total quantity of oil in the reservoir;

S is a cross-sectional area of the portion l of the reservoir; and t is an elevated temperature of oil.

Figure 14:
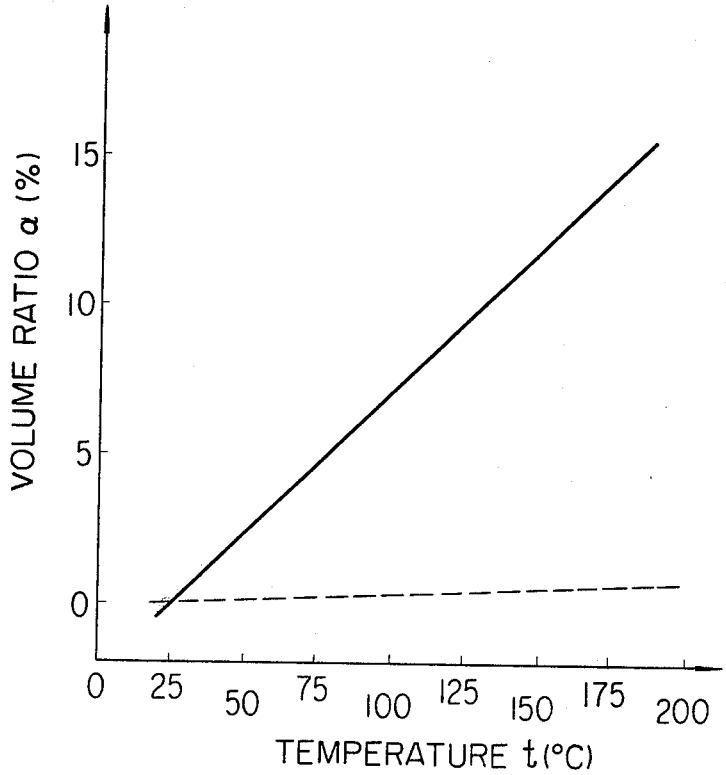
FIG. 14 is a graphical representation showing a relationship between temperature and expansion ratio of silicone oil.

FIG. 14 indicates a relationship between temperature of oil in the reservoir and the expansion ratio thereof, in which dimethyl polysiloxane oil is used as silicone oil, and the volume of this oil at 25° C. is set 1. In this graphical representation, the abscissa indicates the temperature t of the oil, and the ordinate denotes the volume ratio with respect to the oil volume at 25° C. ($\alpha=Vt/V_{Rt}\times 100$, where Vt is the oil volume at t° C., and $V_{Rt}$ is the oil volume at 25° C.). The dash line in the graph indicates the expansion ratio of the vessel for the oil reservoir made of iron. In order to know substantial change in the liquid surface level of silicone oil in the reservoir, the expansion coefficient of the vessel for the reservoir should be taken into consideration. In the embodiment of FIGS. 13A and 13B, when a vessel for the reservoir 420 made of iron having a dimension of 50 mm in height, 12 mm in width, and 380 mm in length is provided in the image fixing device, it can be recognized that the liquid surface level rises by 9 mm in 30 minutes after electric conduction to the heater in the heat fixing roller. The distance l, in which the liquid surface moves up and down, can be set to an intended value by appropriate designing of the volume and cross-sectional area of the vessel for the reservoir, and the temperature rise in the liquid, etc. due to heat from the heat-fixing roller.

In the foregoing, expalanations have been made with reference to particular embodiments of the liquid feeding device according to the present invention, in which silicone oil to be fed is thermally expanded in utilization of heat from the image fixing device. It is, of course, possible that the liquid surface is also controlled in utilization of the thermal expansion of other liquid or gas placed near the image-fixing device.

What we claim is:

1. An image fixing device for fixing a powder image on an image holding member comprising:

first and second rollers at least one of which is heated, said rollers being adapted to grip and transport therebetween an image holding member and fix a powder image held thereon; and liquid feeding means for feeding offset preventing liquid to said first roller, said liquid feeding means including:

a reservoir for storing the offset preventing liquid, liquid holding means for absorbing the offset preventing liquid within said reservoir through capillary action and holding it, liquid applying means, in contact with said liquid holding means and said first roller, for receiving the offset preventing liquid from said liquid holding means and applying it to said first roller, and liquid level control means for lowering, during a non-feeding period of the offset preventing liquid, the level of the offset preventing liquid to a level to increase the vertical distance between the level of the offset preventing liquid and the contact position between said liquid holding means and said liquid applying means, and raising the level to a level, during a feeding period of the offset preventing liquid, to reduce said vertical distance.

2. A device according to claim 1, wherein said liquid applying means includes a roller.

3. An image fixing device for fixing a powder image on an image holding member comprising:

first and second rollers at least one of which is heated, said rollers being adapted to grip and transport therebetween an image holding member and fix a powder image held thereon; and liquid feeding means for feeding offset preventing liquid to said first roller, said liquid feeding means including:

a reservoir for storing the offset preventing liquid, liquid holding means for absorbing the offset preventing liquid within said reservoir through capillary action and holding it, said liquid holding means being in contact with said first roller to apply the offset preventing liquid to said first roller, and liquid level control means for lowering, during a non-feeding period of the offset preventing liquid, the level of the offset preventing liquid to a level to increase the vertical distance between the level of the offset preventing liquid and the contact position between said liquid holding means and said first roller, and raising the level to a level, during a feeding period of the offset preventing liquid, to reduce said vertical distance.

4. A device according to claim 1, 2 or 3 wherein said control means includes limiting means for preventing the liquid level from exceeding a predetermined level during the feeding period of the offset preventing liquid.

5. A device according to claim 4, wherein said limiting means removes offset preventing liquid from said reservoir.

6. A device according to claim 1, 2 or 3 wherein said control means includes means for adjustably moving the level of the offset preventing liquid within a predetermined range during the feeding period of the offset preventing liquid.

7. A device according to claim 6 wherein said level adjusting means lowers the level of the offset preventing liquid in response to a temperature rise thereof.

8. A device according to claim 1, 2 or 3 wherein said control means raises the level up to a predetermined high level in a predetermined time period after commencement of the liquid feed.

9. A device according to claim 8, wherein said control means includes pump means for supplying the offset preventing liquid to said reservoir, an outlet provided in said reservoir at a level lower than said predetermined high level, a discharge opening for discharging the liquid coming from said outlet, and a liquid passage for effecting communication between said outlet and said discharge opening.

10. A device according to claim 1, 2 or 3 wherein said liquid holding means is located so that it is out of contact with the surface of the offset preventing liquid when the level of the offset preventing liquid is at the low level.

11. A device according to claim 1, 2 or 3, 20 or 21, wherein said liquid holding means is located so that it is immersed in the offset preventing liquid both when the level of the offset preventing liquid is at the high level and when it is at the low level.

* * * * *